US005542148A

United States Patent [19]

Young

[11] Patent Number: 5,542,148

[45] Date of Patent: Aug. 6, 1996

[54] BROOM ASSISTED PICK-UP HEAD

[75] Inventor: Gary B. Young, Waco, Tex.

[73] Assignee: Tymco, Inc., Waco, Tex.

[21] Appl. No.: 480,711

[22] Filed: Jun. 7, 1995

Related U.S. Application Data

[62] Division of Ser. No. 378,930, Jan. 26, 1995, which is a continuation of Ser. No. 725,108, Jul. 3, 1991, abandoned.

[51] Int. Cl.[6] ..... E01H 1/08

[52] U.S. Cl. ..... 15/346; 15/340.3; 15/82; 15/422.1

[58] Field of Search ..... 15/340.1, 340.3, 15/340.4, 346, 82, 83, 422.1

[56] References Cited

U.S. PATENT DOCUMENTS

| | | | |
|---|---|---|---|
| 2,913,744 | 11/1959 | Gregersen | 15/340.3 X |
| 3,078,496 | 2/1963 | Doran et al. | 15/346 |
| 3,512,206 | 5/1970 | Young | 15/346 |
| 3,636,585 | 1/1972 | Larsen | 15/340.3 X |
| 3,886,623 | 6/1975 | Landesman et al. | 15/340.3 X |
| 4,773,121 | 9/1988 | Young | 15/346 |

*Primary Examiner*—Chris K. Moore
*Attorney, Agent, or Firm*—Diller, Ramik & Wight, PC

[57] ABSTRACT

A pick-up head is formed by a housing which defines a broom chamber rearward of an associated air pressure chamber and its associated blast orifice. The broom is rotated in a direction to impel debris from a surface in the same direction as air emitted from the blast orifice toward an associated air suction chamber. Due to the latter arrangement, debris which is "tacky" which is "stuck" onto the surface, or which is too heavy to be moved into the suction air stream by the blast air alone is impelled at a relatively high entrainment velocity toward and into the air suction stream which continues the movement of this debris for eventual discharge into an associated hopper.

15 Claims, 10 Drawing Sheets

BROOM ASSISTED PICK-UP HEAD

This application is a division of application Ser. No. 08/378,930 filed Jan. 26, 1995, which is a continuation of Ser. No. 07/725,108 of Jul. 3, 1991, now abandoned.

BACKGROUND OF THE INVENTION

This invention is directed to pick-up heads of the type disclosed in commonly assigned U.S. Pat. Nos. 3,512,206 and 3,545,181 in the name of Bernard W. Young issued respectively on May 19, 1970 and Dec. 8, 1970 and respectively titled AIR FLOW SURFACE CLEANING APPARATUS and AIR CLEANING APPARATUS.

The latter patents disclose a vehicle which carries a pick-up head, a centrifugal separator, a hopper, and assignee's REGENERATIVE® air circulating system. Air generated by a turbine is directed through a blast orifice of the pick-up head, admixes with and propels the debris to a suction orifice of the pick-up head after which the debris is centrifugally separated and discharged in the hopper, and the air returns to the blast orifice. In this manner debris on roads, roadways, tarmacs, parking lots or the like can be rapidly and efficiently removed. However, while the apparatus of the latter patents represented the state-of-the-art at the time of patenting and continues to do so to date, continued experimentation, research and development has resulted in yet greater efficiency and higher speeds of both debris removal and vehicle travel. Furthermore, the art of road sweepers has advanced considerably since the early 1970's and has become considerably more sophisticated and specialized. Most recently U.S. Pat. No. 4,773,121 was granted on Sep. 27, 1988 to the common assignee, and discloses an improved pick-up head of aerodynamic shape having minimum pick-up head to ground clearance so as to maximize blast air velocity. The latter assures that debris, particular small high mass debris, such as grains of sand, pebbles, pea-gravel or the like can be cleaned from surfaces, specifically and particularly airport runways, tarmacs and the like.

SUMMARY OF THE INVENTION

The present invention is directed to a pick-up head which is of an extremely simple and straightforward construction and utilizes a rotating brush to impel debris into an air stream of an air suction chamber. The broom is mounted in a broom chamber rearward of an associated air pressure chamber and its associated air pressure orifice, and the broom is rotated in a direction to impel debris from an associated surface in the same direction as air emitted from the air pressure orifice or blast orifice toward the associated air suction chamber. Because of the latter arrangement, debris which is "tacky," which may be otherwise "stuck" to the surface, or which is slightly too heavy to be moved into the suction air stream by the air emitted from the blast orifice is impelled or propelled at a relatively high entrainment velocity toward and into the air suction stream which continues the movement of this debris at a predetermined conveying velocity somewhat less than the entrainment velocity. Thus, in those cases where debris cannot be broken loose from a surface simply through the pressurized air blast issuing from the blast orifice, the broom and its direction of rotation agitate or otherwise break loose stuck or heavier debris, impel the same at a high entrainment velocity toward the air exiting the blast orifice, and the latter combined velocities assure conveyance of the debris through the suction chamber and eventual discharge into an associated hopper.

The novel pick-up head of the present invention is also constructed to allow the broom to react to anomalies of the surface along which the pick-up head is adapted to travel. The latter is accomplished by mounting each opposite end of the broom to an associated shaft which is independently pivotally mounted to a housing of the pick-up head. In this manner should the surface which is being swept have abnormally high peaks or low valleys, the broom end portion associated therewith will respectively rise and fall while the opposite end of the broom will essentially maintain its position dependent upon the surface against which it is reacting and independent of the anomalies of the surface at the broom end portion axially opposite thereto. The latter feature is augmented by utilizing an independent fluid piston/cylinder with each axially opposite end portion of the broom, and pressurizing the fluid piston/cylinder thereof in parallel from a common pressure source, such as a conventional hydraulic pump or the like. Because of this arrangement, should the surface have a high anomaly, the end portion of the broom travelling thereover tends to rise which in turn tends to increase the pressure in its associated cylinder and this in turn increases the pressure in the opposite cylinder so that both axial end portions of the broom are basically urged against the surface under the same force. The bristles of the broom end portion reacting against the higher anomalies will tend to deflect and this end portion will tend to rise, whereas the axial opposite end portion of the broom will maintain its status quo. This feature is particularly desirable when the pick-up head is moving along a road and encounters, for example, a solidified concrete truck spill which might be, for example, a foot in width, an inch or so in height, and perhaps a length of twenty feet or more. Due to the construction of the pick-up head just described, the road and those portions of the road immediately adjacent the concrete spill, as well as the top of the concrete spill itself, are cleaned in an efficient and effortless manner.

In further accordance with the present invention, the pick-up head is provided with biasing means associated with the broom to counteract the force of the fluid piston/cylinder mechanisms which normally urge the broom toward the surface being swept. The biasing means include two springs, one each independently associated with each one of the broom end portions. The biasing force of each spring is opposite in direction to that of the associated fluid piston/cylinder mechanism, and thus the fluid piston/cylinder mechanisms work against the force of the springs and the forces created by ground reaction. By adjusting the force of the springs a desired "burn pattern" of the broom upon the surface being swept can be generated and maintained at an efficient level. The adjustment of the springs also compensates for the wear of the brushes of the broom which also have an effect on the desired burn pattern.

In further accordance with the present invention, the broom is mounted for pivotal movement in its associated broom chamber between a pair of pivotally mounted arms, one of which is formed of a pair of members bolted to each other. A shaft of the broom is axially slidably connected to one of the arms and to a first member of the other arm which permits rapid assembly and disassembly of the broom relative to the arms by simply uncoupling and recoupling the pair of members. A worn broom assembly can be removed and replaced by a new broom assembly in 10 to 15 minutes, as opposed to the hour or more now required in conventional pick-up heads. Obviously, reduction in down time for broom replacement reflects an increase in travel time and attendant efficiency.

The broom is also connected at its end portion through polygonal drive connections to the opposite arms. These polygonal drive connections are essentially nonrotatable telescopic couplings which have sufficient clearance to effect parallel misalignment therebetween, i.e. the axes of the couplings are parallel to each other though not coaxially, which also compensates for anomalies of the surface along which the pick-up head is adapted to travel.

In further accordance with this invention the air pressure orifice or blast orifice is defined in part by a relatively elongated plate which is yieldably mounted relative to the housing and can deflect about its neutral axis. A plurality of screws spaced from each other along the elongated plate apply the force to create such deflection which in turn allows the blast orifice to vary in size and shape from a generally rectangular configuration to a tapered configuration normally converging from the suction side toward the pressure side of the pick-up head. This allows the air emitted from the blast orifice to vary along the length thereof to accommodate specific and varied debris conditions.

The pick-up head of the present invention is also associated with a fluid circuit system including a fluid motor for rotating the brush and two fluid piston/cylinder mechanisms, each independently associated with one of the broom end portions. The fluid circuit includes a line for directing pressurized hydraulic fluid to an inlet of the motor and from an outlet of the motor to inlets of the cylinders in a direction urging the broom toward the surface which is to be cleaned and also to a pressure relief valve which can be set at a predetermined pressure. Outlets from the cylinders are in turn connected to each other and to a return to a reservoir. In this manner pressurized fluid, preferably hydraulic fluid, is introduced first into the motor and then through a T-fitting to the pressure relief valve and into the parallel connected cylinders of the fluid piston/cylinder mechanisms which assures that the broom is rotated before it contacts the ground thereby decreasing undesired back pressure. Since the outlet of the fluid motor is connected directly to the inlet of the cylinders for effecting down pressure of the broom against the surface which is being swept, the anomalies of the surface heretofore noted which tend to raise the broom can create undesirably high back pressure forces which can be relieved by the pressure relief valve. Thus, increased broom pressure caused by ground reaction forces is immediately relieved when the relief valve pressure is reached thereby preventing the broom from digging into the surface, thus preventing broom/bristle damage, preventing motor burnout, etc.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
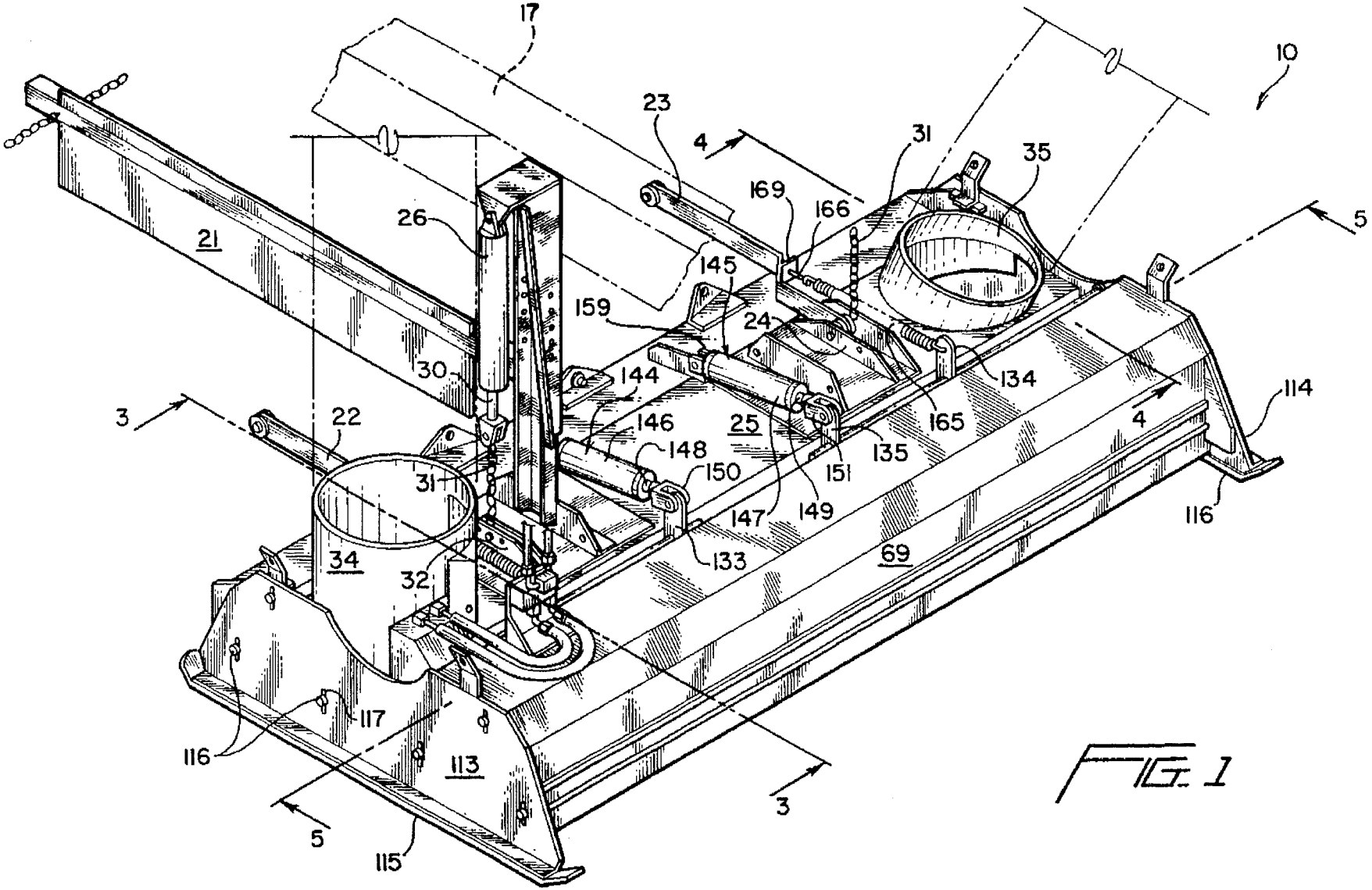
FIG. 1 is a perspective view of a pick-up head of this invention, and illustrates front, top and side walls thereof and a pressurized air inlet and a suction air outlet associated with the top wall.
Figure 2:
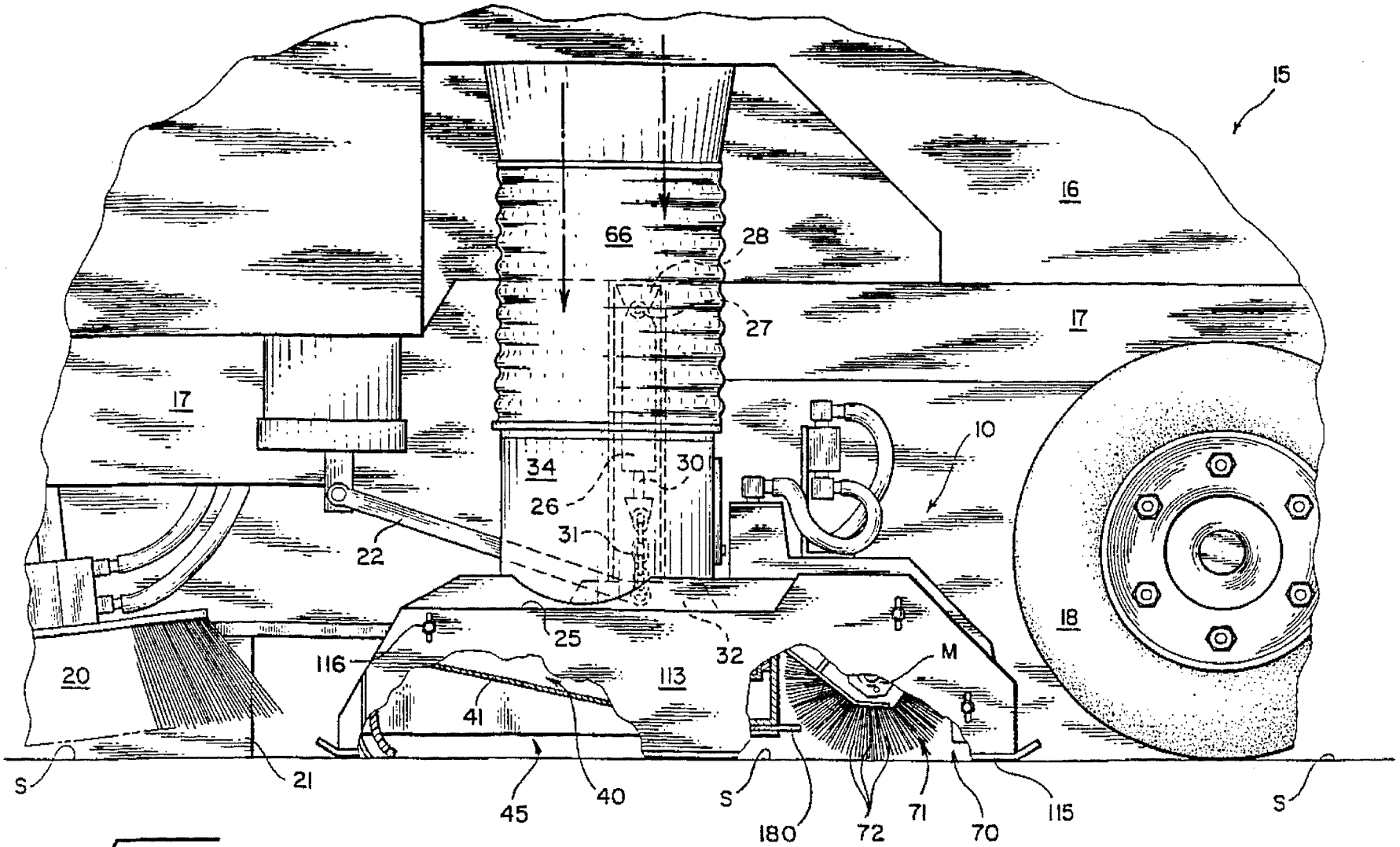
FIG. 2 is a fragmentary side elevational view of a sweeper carrying the pick-up head, and illustrates a suction chamber, a broom chamber and a broom in the broom chamber of the pick-up head.

A novel high speed pick-up head of this invention is generally designated by the reference numeral 10 (FIGS. 1 through 6), and is illustrated in FIG. 2 connected to a sweeper or truck sweeper 15 which includes a hopper 16 carried by a frame 17 which is moved along a surface S in a conventional manner upon the rotation of wheels 18 (only one of which is illustrated). The direction of movement of the sweeper 15 in FIG. 2 is right-to-left. Forwardly of the pick-head 10 is a gutter brush 20 located one each behind the front wheels (not shown) which are constructed and arranged for operation in the manner described in the earlier identified patents in the name of Bernard W. Young. A deflector plate 21 (FIGS. 1 and 2) is conventionally supported between the gutter brushes (20 and unillustrated).

The pick-up head 10 is conventionally supported for vertical up and down movement between the gutter brushes (20 and unillustrated) and the wheels (18 and unillustrated) by pivot rods 22, 23 (FIGS. 1 and 2), each having one end pivotally connected to the frame 17 and an opposite end connected to a bracket 32, 24, respectively (FIG. 1) welded to a top wall 25 of the pick-up head 10. A pair of cylinders 26, 26 (FIGS. 1 and 12) is each pivotally connected by a pivot 27 to a bracket 28 (FIG. 2) which is bolted to the frame 17. A piston rod 30 of each cylinder 26 is connected to a chain 31 which is in turn connected to one of the associated brackets 32, 24 (FIGS. 1 and 2) welded to the top wall 25 of the pick-up head 10. Movement of the rods 30 appropriately raises and lowers the pick-up head 10 relative to the surface S and the debris (not shown) thereupon which is removed in a manner to be described more fully hereinafter.

An air pressure inlet 34 (FIGS. 1 and 3) and an air suction outlet 35 (FIGS. 1 and 4) are in fluid communication through the top wall 25 with a respective air pressure chamber 40 and an air suction chamber 45 separated from each other generally by a plate 41 which is welded at one end (unnumbered) to the top wall 25 (FIG. 3) and is welded to a square tube 42 at its opposite end. The square tube 42 and side edges (unnumbered) of the plate 41 are welded to side walls 43, 44, each having a generally identical downwardly opening rectangular cut-out or slot 46 (FIGS. 3 through 7). The square tube 42 defines an air pressure orifice or blast orifice 60 with a blast orifice curtain or skirt 61 (FIGS. 3, 4 and 7) which is connected by a plurality of nuts and bolts 62 and an apertured plate 63 (FIG. 7) to a plate 64 (FIGS. 3 and 4) depending downwardly from the top wall 25. The skirt 61 spans the distance between the side walls 43, 44 and is constructed from relatively flexible material.

Figure 3:
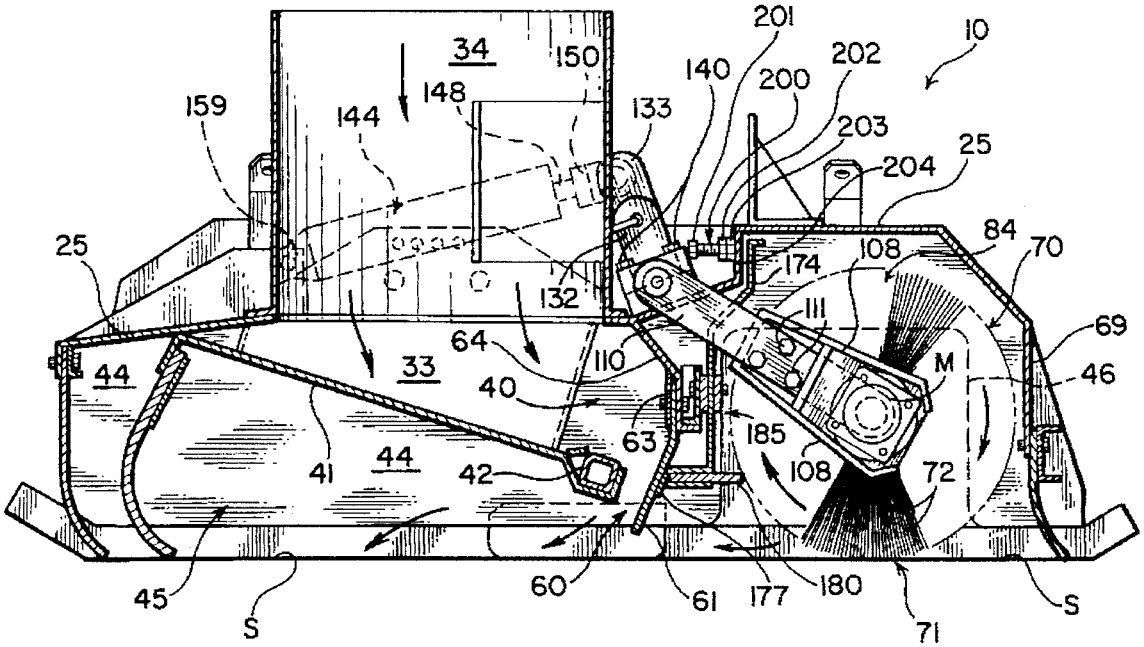
FIG. 3 is a cross-sectional view taken generally along line 3—3 of FIG. 1, and illustrates an arm pivotally mounting one end of the broom adjacent the pressure inlet, an air pressure chamber, a blast orifice associated with the air pressure chamber, and a yieldably mounted elongated plate which can be deflected along its neutral axis to vary the shape and/or size of the blast orifice.
Figure 4:
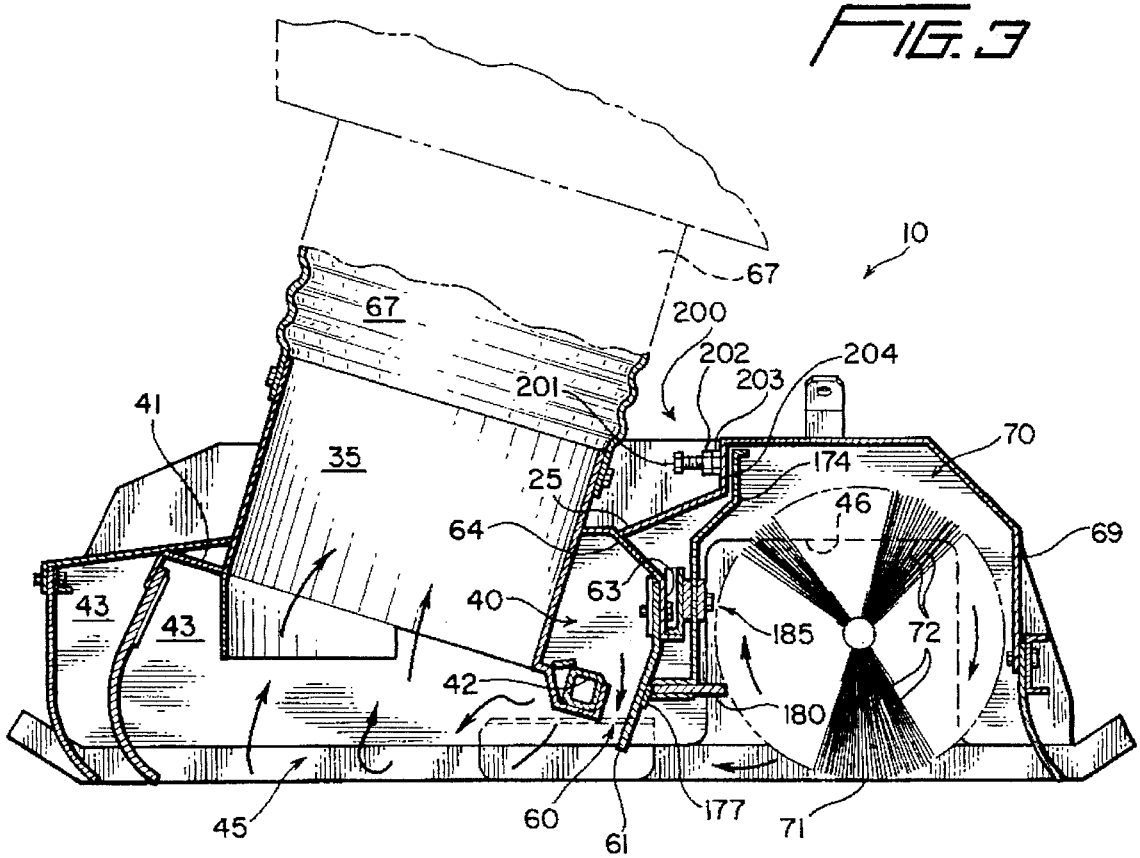
FIG. 4 is a cross-sectional view taken generally along 4—4 of FIG. 1, and illustrates structure similar to that shown in FIG. 3 adjacent the suction outlet of the pick-up head.

As is described in the first two-mentioned patents, pressurized air entering the pressure inlet 34 through an associated flexible tube 66 (FIG. 2) in a downward direction, as indicated by the unnumbered headed arrows associated therewith in FIG. 2, flows lengthwise along the air pressure chamber 40 between the side walls 43, 44 and exits the blast orifice 60 along the length thereof in the manner indicated by the unnumbered headed arrows in FIG. 3. The pressurized air exiting the blast orifice 60 is directed generally forwardly or in the direction of vehicle travel which in FIGS. 3 and 4 is from right-to-left. Thus, any debris on the surface S is agitated, loosened and entrained at a predetermined entrainment velocity and propelled thereby into the air stream flowing in the suction chamber 45 from left-to-right, as viewed in FIG. 1, as air is drawn outwardly from the pick-up head 10 through the air suction outlet 35 and conducted by an associated flexible tube 67 (FIG. 4) to the hopper (not shown) of the sweeper 15. Under normal conditions, the high entrainment velocity of the pressurized air exiting the blast orifice 60 is sufficient to clean the surface S of debris, but in some cases debris is stuck to the surface S and will not break loose under air pressure and must be agitated or brushed therefrom.

Figure 5:
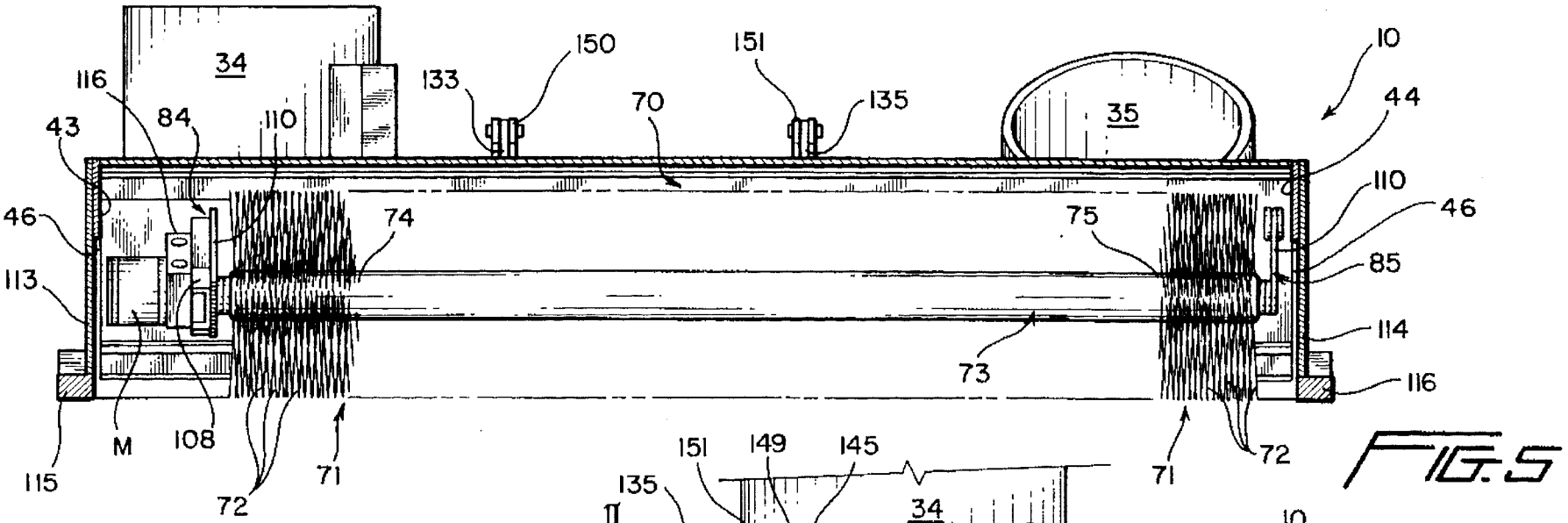
FIG. 5 is a cross-sectional view taken generally along line 5—5 of FIG. 1, and illustrates the broom in generally spanning relationship between side arms of the pick-up head, end portions of the broom connected to pivotally mounted arms, and a fluid motor carried by one of the arms for rotating the broom.

Accordingly, in further accordance with this invention, the pick-up head 10 is provided with a broom chamber 70 defined between the top wall 25, the side walls 43, 44 (FIG. 5), the skirt 61 (FIGS. 3 and 4) and a rear wall 69. Broom means 71 in the form of a broom is housed within the broom chamber 70, and is defined by a plurality of bristles 72 projecting radially outwardly from and continuously along the length of a hollow tubular shaft 73 having opposite first and second end portions 74, 75, respectively (FIG. 5). The shaft end portions (74, 75) each internally receive a respective fitting 76, 77 (FIG. 10) which is welded to the shaft 73. The fittings 76, 77 include respective polygonal, substantially square, openings 78, 79. The openings 78, 79 are connected to and in part defined journals for effecting rotation of the broom 71 clockwise, as viewed in FIGS. 3 and 4, in a manner to be described more fully hereinafter.

Figure 7:
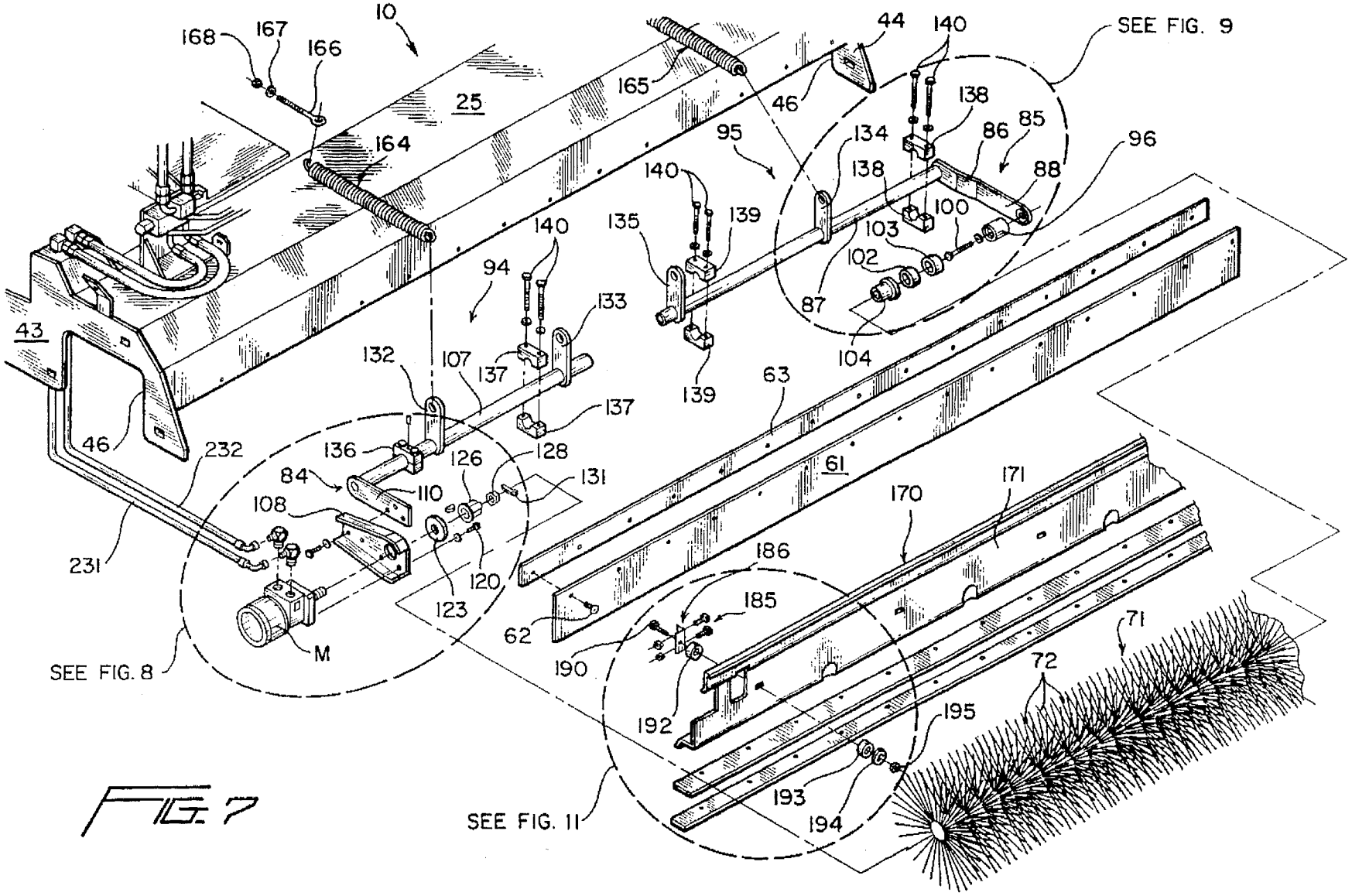
FIG. 7 is an exploded view of a portion of the pick-up head of FIG. 1, and illustrates details of the pivotal mounting of the broom relative to the pick-up head and the yieldable mounting of the deflectable plate for changing the size/shape of the blast orifice.

The shaft 73 is not only mounted for rotation at each of its opposite end portions 74, 75, but is also mounted for axial assembly and disassembly relative to respective arms 84, 85 which are in turn part of respective independent broom pivotal mounting mechanisms 94, 95, respectively (FIG. 7).

The arm 85 (FIGS. 5, 7 and 10) include an end portion 86 welded to a shaft 87 and an opposite end portion 88 carrying an internally threaded nut 91. The internally threaded nut 91 is received in an opening (unnumbered) of the end portion 88 of the arm 85 and is appropriately welded thereto. The nut 91 includes a cylindrical shoulder 92 which is received in a counterbore 93 of a cylindrical spindle 96 having a medial bore 97 and another counter bore 98. A threaded bolt 100 is passed through a washer 101 and the spindle 96 and is threaded into the threaded nut 91 with the shoulder 92 thereof received in the counterbore 93. Cylindrical brass bearings 102, 103 having interior Teflon surfaces are slipped over the spindle 96. A hub 104 of a generally tubular configuration includes an internal cylindrical surface 105 corresponding in size to the exterior of the bearings or bushings 102, 103. An exterior surface 106 of the hub 104 is of a polygonal, preferably square, configuration generally matching the polygonal/square configuration of the opening or aperture 79 of the fitting 77. Thus, the rectangular opening 79 of the shaft end portion 75 can be axially slipped upon and axially removed from the like square matching configuration of the outer surface 106 of the hub 104. The fit between the square surfaces 79, 106 is relatively loose allowing radial play which allows parallel misalignment during operation when the broom 71 encounters anomalies along the surface S during operation, as will be described more fully hereinafter.

Figure 8:
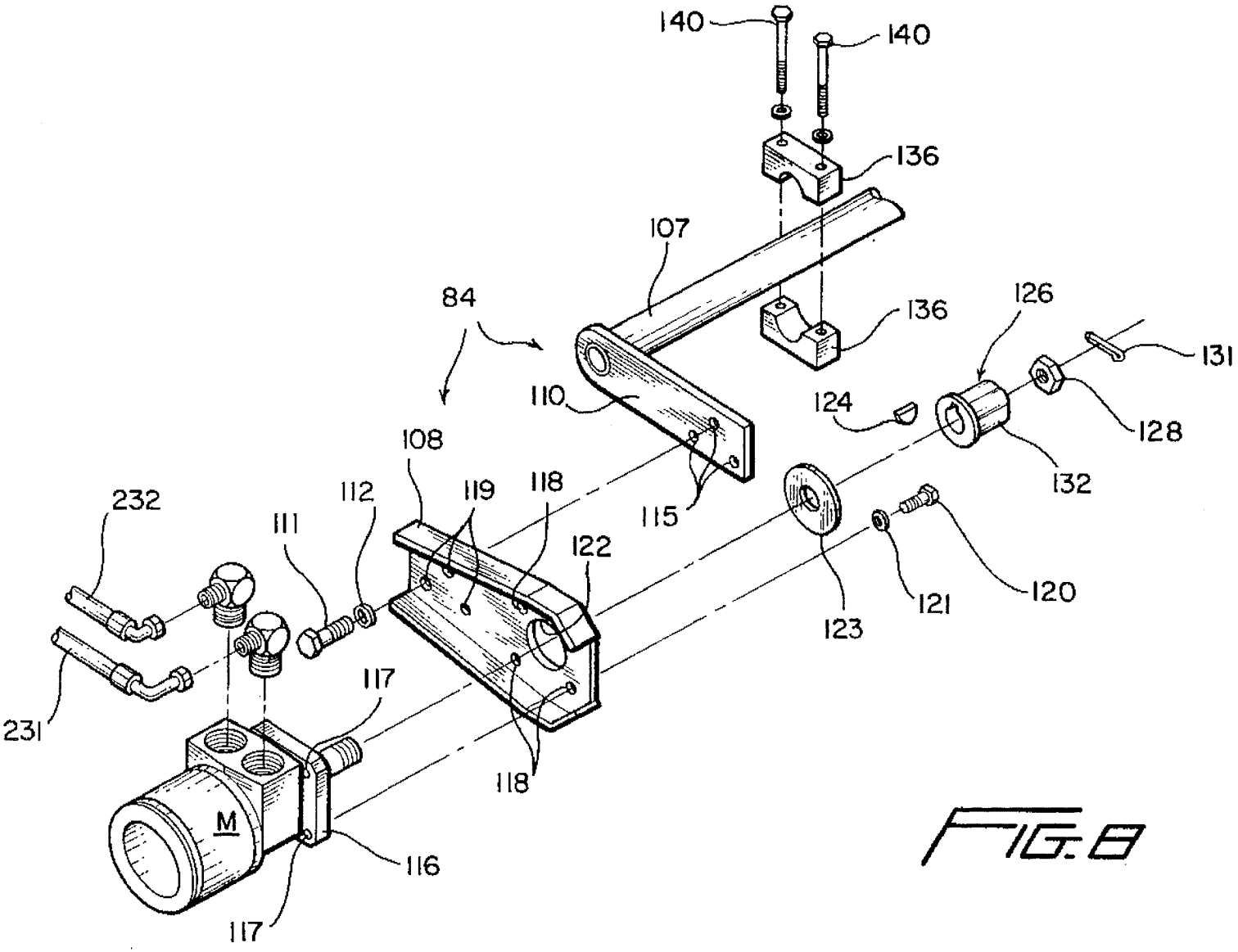
FIG. 8 is an enlarged perspective view of the associated encircled portion of FIG. 7, and illustrates the details of the mounting of the fluid motor to an arm of the pivotal mounting mechanism and through a drive connection to one end portion of the broom.

The end portion 74 of the shaft 73 is connected to a drive shaft 107 of a fluid (hydraulic) motor M (FIG. 10) which is removably secured to a first member 108 of the arm 84. The first member 108 is in turn secured to a second member 110 of the arm 84. The securement of the members 108, 110 to each other is through threaded bolts 111 and washers 112 (FIG. 8). The bolts 111 pass through openings 119 in the member 108 and are threaded into aligned threaded openings 115 in the member 110.

The motor M has a mounting flange 116 provided with four threaded bores 117 (FIG. 10) which are aligned with four openings 118 in the member 108. A bolt 120 associated with a washer 121 is passed through each of the openings 118 and is threaded into an associated one of the threaded bores 117 to rigidly secure the motor M to the member 108 of the arm 84 with the shaft 107 projecting through an enlarged opening 122 (FIG. 8) of the member 108.

Figure 10:
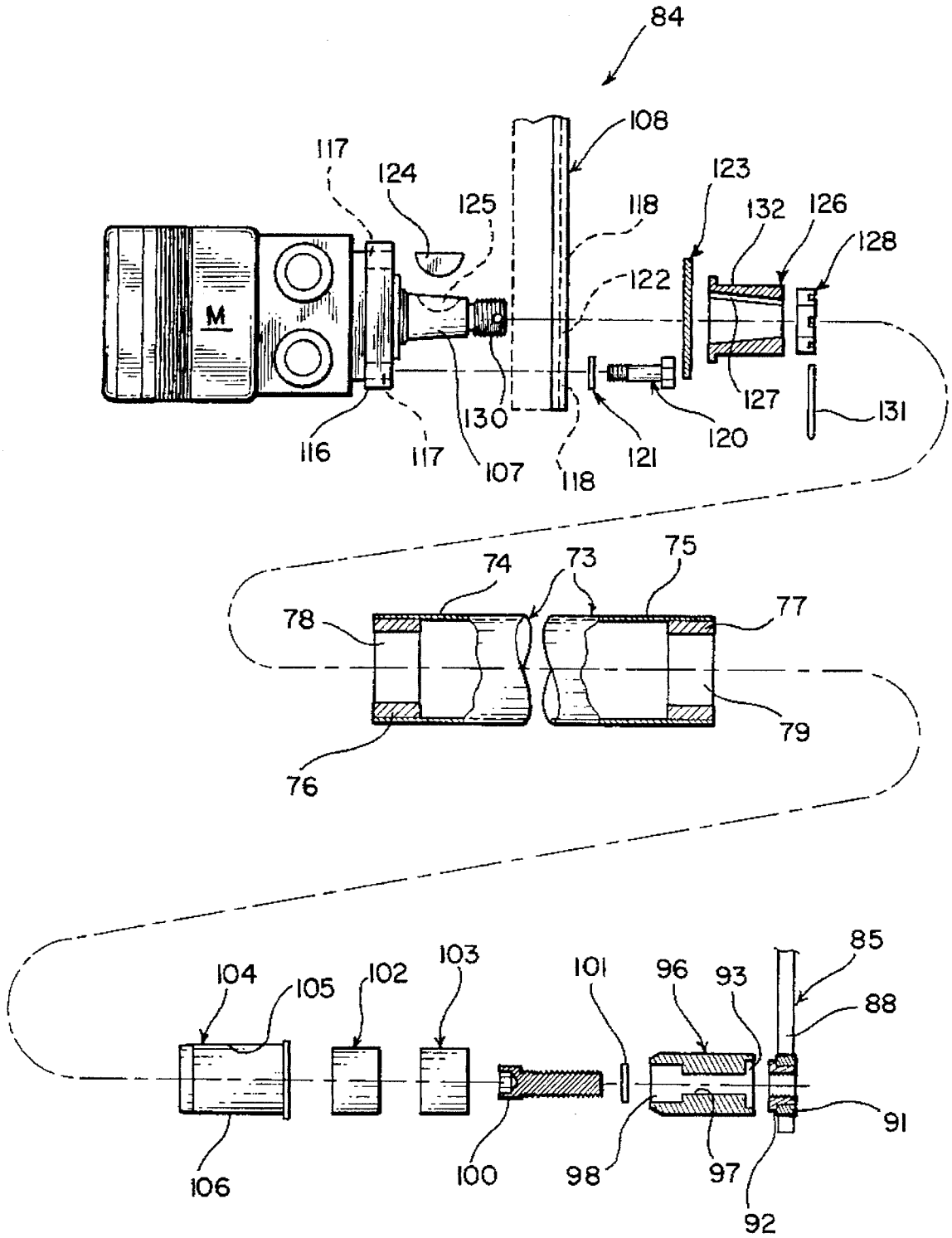
FIG. 10 is an enlarged exploded fragmentary assembly view of the arms, motor and shaft of the broom, and illustrates the manner in which the motor is connected to the arm, is drivably connected to one end of the shaft, and an opposite end of the shaft is connected to the adjacent arm.

A washer 123 is slipped over the shaft 107 and against the right-hand face (unnumbered), as viewed in FIGS. 8 and 10, of the member 108. A key 124 is slipped into a slot 125 of the drive shaft 107 and a drive hub 126 is slipped on the shaft 107. The hub 126 has an axial keyway 127 which registers with the key 124 to lock the hub 126 nonrotatably fixed to the drive shaft 107. A lock nut 128 is threaded upon a threaded end portion 130 of the shaft 107 and is locked in position by a cotter pin 131. An exterior surface 132 of the hub 126 is polygonal, preferably square, and in loose matching configuration to the square configuration of the opening 78 of the fitting 76 (FIG. 10) of the shaft end portion 74. Thus, the hub 126 can be axially slid into and out of the square opening 78 just as the hub 104 can be axially slid into and out of the square opening 79 of the fitting 77 of the shaft end portion 75. The latter connections effect parallel misalignment between the axes of the hubs 104, 126 and the axes of the openings 78, 79, respectively. The aforementioned radial play between the hubs 104, 126 and the openings 78, 79, respectively, can, for example, permit the broom shaft 73 to shift such that its axis and that of the openings 78, 79 are parallel to but radially offset from (misaligned) the axis between the hubs 104, 126. Similarly, the aforementioned radial play between the hubs 104, 126 and the openings 78, 79, respectively, can, for example, permit angular misalignment between each axis (unnumbered) of the spindles 96, 107 and the associated axes of the openings 79, 78, respectively.

The member 110 of the arm 84 (FIG. 8) is welded to a shaft 107 of the pivoting mounting mechanism 94.

Figure 6:
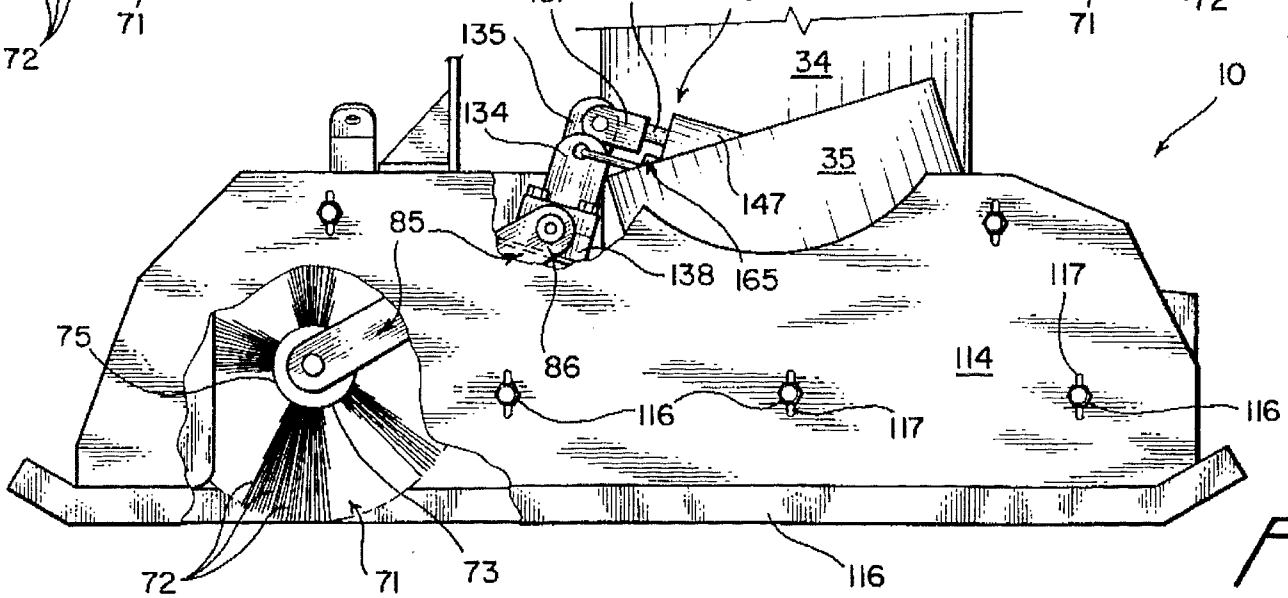
FIG. 6 is a fragmentary side elevational view looking from right-to-left in FIG. 5, and illustrates the arm pivotally mounting an end portion of the broom at the suction side of the pick-up head.
Figure 9:
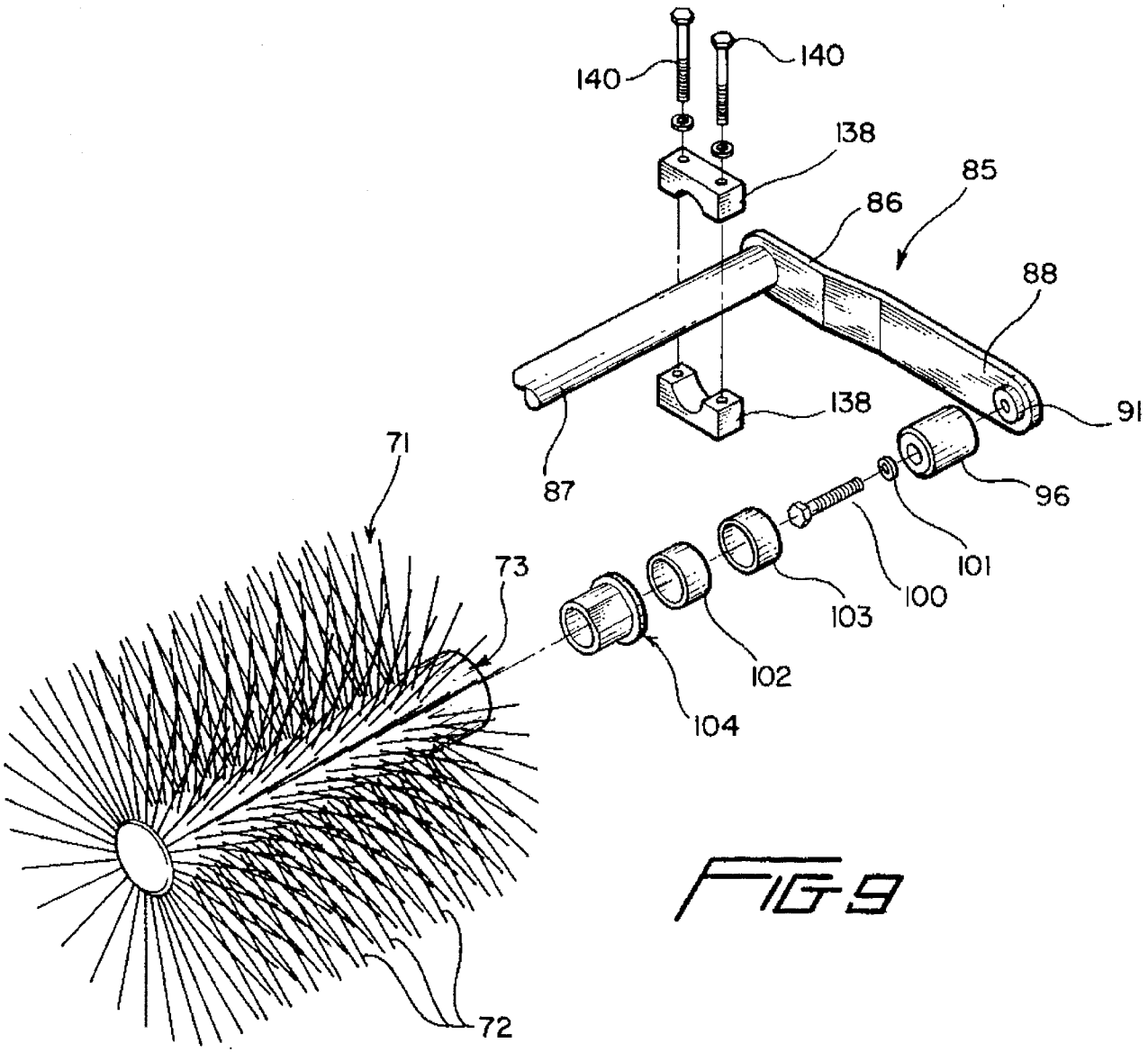
FIG. 9 is an enlarged exploded view of the associated encircled portion of FIG. 7, and illustrates the details of the manner in which an opposite end of the broom is axially connected to a pivoted arm adjacent the suction end of the pick-up head.

As is best illustrated in FIGS. 1 through 6 of the drawings, each of the side walls 43, 44 is exteriorly covered by a skid plate 113, 114, respectively. The skid plates 113, 114 carry respective skids 115, 116 which are constructed from hardened metal and might include carbide inserts to decrease wear and increase the life thereof as the same move along the surface S. The skid plates 113, 114 are conventionally bolted by bolts 116 to the side plates 43, 44 after passing through adjusting slots 117 (FIG. 6). As is best illustrated in FIGS. 5 and 6, the skid plates 113, 114 cover the cut-outs or slots 46 of the respective side walls 43, 44. However, the bolts 116 need but be removed to gain access to the axially opposite end portions 74, 75 of the shaft 73 through the slots 44 should it be desired to at any time assemble, disassemble and/or replace the broom 71. For example, assuming that the skid plates 113, 114 have been removed by first removing the bolts 116, the broom 71 is readily removed by simply removing the bolts 111 (FIG. 8) from the nuts 113 through the access slot 46 (See FIG. 7). The motor M remains fastened to the arm 108, but the arm 108 can now be pulled to the left, and as viewed in FIGS. 5 and 7, toward, into and through the cut-out or slot 46. During this leftward movement, the hub 126 is pulled out of the openings 78 which releases or frees the left end portion 74 of the broom 71 (See FIG. 10). The entire broom 71 can then be pulled to the left causing the end portion 75 and specifically the fitting 77 thereof to be slid to the left and removed from the hub at 104. Thus, the broom 71 is removed by simply removing three bolts 111, shifting the motor M while it remains assembled to the arm 108 to the left, and shifting the broom shaft 73/broom 71 to the left, activity which can all be accomplished by one person operating from the left-hand side from the pick-up head 10, as viewed in FIG. 5, with the pick-up head 10 simply being in its elevated position. Once the broom 71 has been removed, it can, for example, be switched end-for-end if worn improperly. For example, the broom bristles 72 might be so worn as to impart a tapered configuration to the broom 71 which if shifted end-for-end would still allow the broom 71 to be used for a considerable length of time in an efficient manner. Alternatively, the broom 71 can be removed and a new broom reassembled by the reversal of the operation just described. However, in keeping with this invention, it is also preferable to remove the hub 104 and the two bushings 102, 103 from the spindle 96 which, as viewed in FIGS. 9 and 10, is achieved by simply pulling the hub 104 and the bushings 102, 103 to the left to remove the same from the spindle. The hub 104 and the bushings 102, 103 would be replaced by new bushings and hubs slipped upon the spindle 96 (or into the broom shaft 73) by left-to-right movement, as viewed in FIG. 10. A new broom would then be assembled by axially sliding the fitting 77 of the end portion 75 upon the new hub 104 and slipping the or a new hub 126 into the opening 78 after which the member 108 is rebolted to the member 110 of the arm 84 by the bolts 111. If desired, the hub 126 can also be removed at any time after the member 108 has been disassembled from the member 110 and replaced by a new hub 126, should such be desired. However, it is important to note that the assembly and disassembly just described can be accomplished by only one person in ten to fifteen minutes time by simply removing and replacing the three bolts 111 and the associated washers 112.

Obviously, once reassembly has taken place as described, the skid plates 113, 114 can be rapidly bolted in adjusted position relative to the respective side walls 43, 44 by the nuts 117 (FIG. 6).

Reference is particularly made to FIGS. 1, 3, 6, 7 and 8 which collectively illustrate the manner in which the pivotal mounting mechanisms 94, 95 (FIG. 7) independently urge the respective opposite end portions 74, 75 of the broom shaft 73, and thus the entire broom 71 itself in a generally downward direction toward the surface S whereupon the opposite ends of the broom can independently react to anomalies of the surface S during a sweeping operation.

The pivotal mounting mechanisms 94, 95 each include the respective shafts 107, 87, heretofore described, which are rigidly secured by welding to the member 110 of the arm 84 and the arm 85, respectively (FIG. 7). The shafts 107, 87 carry respective additional arms or members 132, 133 and 134, 135. The arms 132, 133 are welded to the shaft 107 while the arms 134, 135 are welded to the shaft 87. Two pairs of split bearing blocks 136, 137 and 138, 139 rotatably embrace the respective shafts 107, 87 and are secured to the top wall 25 of the pick-up head 10 by pairs of threaded bolts 140 (FIGS. 3 and 7). The split bearing blocks 136 through 139 thereby pivotally mount the shafts 107, 87, respectively, with their axes in alignment and generally parallel to the axis (unnumbered) of the broom shaft 73. Since the shafts 87, 107 are not united in any fashion, it is to be particularly noted that the pivotal mounting mechanism or means 94 is associated with the end portion 74 of the shaft 73 totally independently of the pivotal mounting mechanism or means 95 which is likewise associated with the end portion 75 of the shaft 73 totally independently of the pivotal mounting mechanism or means 94.

Independent fluid piston/cylinder mechanisms or means 144, 145 (FIG. 1) are associated with the respective pivotal mounting mechanisms or means 94, 95. The mechanisms 144, 145 include respective cylinders 146, 147 and piston rods 148, 149 which are in turn pivotally connected through respective bifurcated brackets 150, 151 to the respective arms 133, 135 which project upwardly beyond the top wall 25. The cylinders 146, 147 are also pivotally connected to identical bifurcated brackets 159 which are welded to the top wall 25. The cylinders 146, 147 are part of a hydraulic circuit system 150 (FIG. 12) which also includes the motor M for rotating the brush 71. The cylinders 146, 147 include inlet lines or ports 151, 152, and outlet lines or drain ports 153, 154, respectively. When fluid, such as oil under pressure, is introduced into the lines 151, 152, the piston rods 148, 149 are extended outwardly of the cylinders 146, 147, respectively, causing the arms 133, 135 to rock or pivot to the right, as viewed in FIGS. 1, 3 and 7, which causes clockwise rotation of the shafts 107, 87, as viewed in these figures. The latter clockwise rotation causes the arms 84, 85 to likewise pivot clockwise moving the brush 71 downwardly and forcefully against the surface S. Obviously, during the latter defined movement of the rods 148, 149, the fluid exhausts the cylinders 146, 147 over the respective lines 153, 154, as will be described more fully hereinafter. Just as obvious is the fact that fluid introduced through the lines 153, 154 and vented through the lines 151, 152 will result in the retraction of the rods 148, 149, respectively, and the counterclockwise rotation of the shafts 107, 87, the arms 133, 135, the arms 84, 85 and the broom 71 carried by the latter.

Means 164, 165 (FIG. 7) are independently associated with each of the pivotal mounting means or mechanisms 94, 95 and continuously apply spring-biasing forces tending to urge or pivot the shafts 107, 87 and the arms 84, 85 thereof in a counterclockwise direction, again as viewed in FIGS. 3 and 7, thus likewise continuously tending to urge the broom 71 away from the surface S. The means 164, 165 are in each case a tension spring having one end connected to the respective arms 132, 134 and an opposite end connected to a respective threaded bolt 166 which in turn passes through an aperture (unnumbered) of a bracket 169 (FIG. 1) welded to the top wall 25 of the pick-up head 10. A washer 167 and an associated nut 168 is threaded to each of the bolts 166 to draw the bolts 166 to the left, as viewed in FIG. 1 and 7, for increasing the tension of the springs 164, 165 or vice versa. Accordingly, the fluidic force of the piston/cylinder mechanisms 144, 145 when operated in a direction to urge the broom 71 toward the surface S is counteracted by the opposite forces of the springs 164, 165 to effect counterbalancing of broom movement and augment the parallel misalignment function as the broom 71 travels over anomalies of the surface S.

Figure 11:
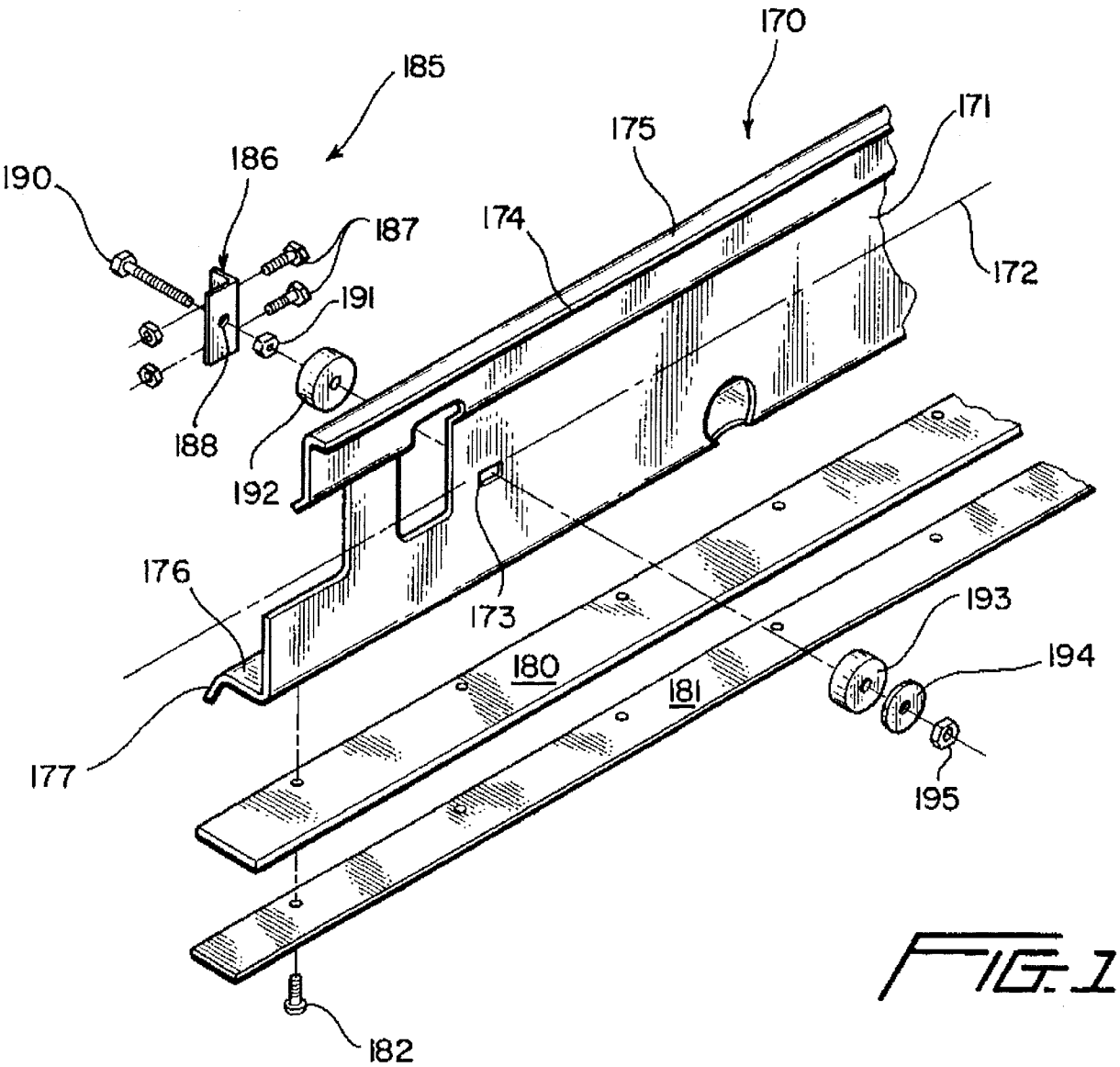
FIG. 11 is an enlarged fragmentary view of the associated encircled portion of FIG. 7, and illustrates details of a plurality of yieldable connections for the deflectable plate which varies the size/shape of the blast orifice.

The blast orifice 60 (FIGS. 3 and 4) is also preferably selectively adjustable in size and shape by means 170 (FIGS. 3, 4, 7 and 11). The blast orifice size and shape altering means 170 is defined by a relatively elongated metallic deflectable plate or member 171 which essentially spans the distance between the side walls 43, 44. The elongated member or plate 171 has a neutral axis generally designated by the reference numeral 172 (FIG. 11) and located thereat are five elongated slots 173. Only one slot 173 is illustrated in FIG. 11, but the five slots 173 are located generally equally spaced from each other. The plate 171 includes an upper end portion 174 having a terminal edge 175 bent rearwardly for reinforcing purposes. A lower end portion 176 of the plate 171 is bent forwardly and thereafter a terminal end 176 is bent downwardly and forwardly. The lower terminal end 177 along its entire length between the side walls 43, 44 bears against the curtain 61 (FIGS. 3 and 4) and holds the curtain 61 in a desired orientation and in selected spaced relationship from the tube 42 to establish the size and configuration of the blast orifice 60. A broom wipe curtain 180 constructed of flexible material is connected to the lower generally horizontal end portion 176 by a plate 181 and a plurality of fastening means 182 passing through associated openings in the plate 181 and the broom wiper curtain 180. A free terminal edge (unnumbered) of the broom wiper curtain 180 is positioned to lightly contact the bristles 72 of the brush 71 during rotation of the latter, in the manner best illustrated in FIGS. 3 and 4 to continuously clean and remove debris therefrom.

Means generally designated by the reference numeral 185 (FIG. 11) are associated with each of the slots 173 for resiliently mounting the elongated plate 171 within the pick-up head 10 and specifically within the broom chamber 70 (FIGS. 3 and 4). Each of the resilient mounting means 185 includes a blast orifice hanger bracket 186 of a generally L-shaped configuration having a pair of legs (unnumbered). One leg of each hanger bracket 186 is secured by a pair of nuts and bolts 187 to a projecting portion (unnumbered) of the plate 63 (FIGS. 3 and 4). Another leg (unnumbered) of the bracket 186 has an opening 188 through which passes a threaded bolt 190. A nut 191 is threaded upon the threaded bolt 190 and rigidly secures the threaded bolt 190 to the hanger bracket 186. A relatively thick cylindrical resilient rubber grommet 192 is slipped on each bolt 190 after which each bolt 190 is passed through one of slots 173. Thereafter another resilient thick rubber grommet 193 is slipped on each bolt 190 followed by a washer 194 and a nut 195. In this fashion the resilient mounting means 185 resiliently mount the elongated plate 171 at five points along its length and, of course, along its neutral axis 172.

Means 200 (FIGS. 3 and 4) are associated with each of the resilient mounting means 185, and each of the means 200 includes a bolt 201 threaded in a jamming nut 202 and a second nut 203 which is welded to an upstanding plate portion 204 of the top wall 25 (FIGS. 3 and 4). A terminal end (unnumbered) of each bolt 201 bears against the upper end portion 174 of the elongated plate 171. When the jamming nuts 202 are backed-off (unthreaded to the left in FIGS. 3 and 4) their respective threaded bolts 201 can be threaded to the right or to the left, as viewed in FIGS. 3 and 4. If the three bolts 201 are threaded an equal distance to the right, the top end portion 174 of the elongated plate 171 will be moved to the right and the blast orifice curtain 61 will be moved to the left, as viewed in FIGS. 3 and 4, causing the entire elongated plate 171 to pivot about its neutral axis 172 which in turn causes the lower terminal end 177 of the elongated plate 171 to move an approximate equal distance toward the square tube 42 thereby reducing the size of the blast orifice 60. If each of the bolts 201 is unthreaded an approximate equal amount by movement to the left, again as viewed in FIGS. 3 and 4, the converse occurs and the size of the blast orifice 60 is increased. It should be noted that if the bolts 201 are approximately equally moved to the right or to the left, again as viewed in FIG. 4, the entire bottom terminal edge 177 of the plate 171 and the blast orifice curtain 61 will likewise move approximately equally toward or away from the tube 42. Thus, if the blast orifice 60 were of a rectangular configuration, as viewed from above or below, the adjustment just defined would maintain this rectangular or polygonal configuration and would merely change the size (width) thereof. However, at times it is desirable to alter the square or polygonal configuration of the blast orifice 60 such that, for example, the blast orifice 60 converges in size from the suction outlet 35 toward the pressure inlet 34. In order to accomplish the latter, the three bolts 201 are threaded or unthreaded different relative distances. For example, the centrally located bolt 201 can be threaded a predetermined distance further into the broom chamber 70, the bolt 201 nearest the pressure inlet 34 (FIG. 3) is threaded the greatest distance into the brush chamber 70 and the bolt 201 nearest the suction outlet 35 (FIG. 4) is threaded the least distance into the brush chamber 70. Thus, the three bolts are threaded different distances into the brush chamber resulting in the elongated plate deflecting or bending relative to its neutral axis 172 as opposed to purely pivoting thereabout, as would occur if the bolts 201 were moved equal distances into or out of the broom chamber 70. In addition to the elongated plate 171 deflecting about its neutral axis, the grommets 192, 193 will yield or compress to augment the latter-described deflection. In this fashion, the blast orifice 60 will be at its maximum width adjacent the suction outlet 35 and at its minimum width adjacent the pressure inlet 34. In this case the blast orifice curtain 61 is not parallel to the square tube 42 but instead tapers uniformly relative thereto to impart the overall tapering configuration to the blast orifice 60.

Figure 12:
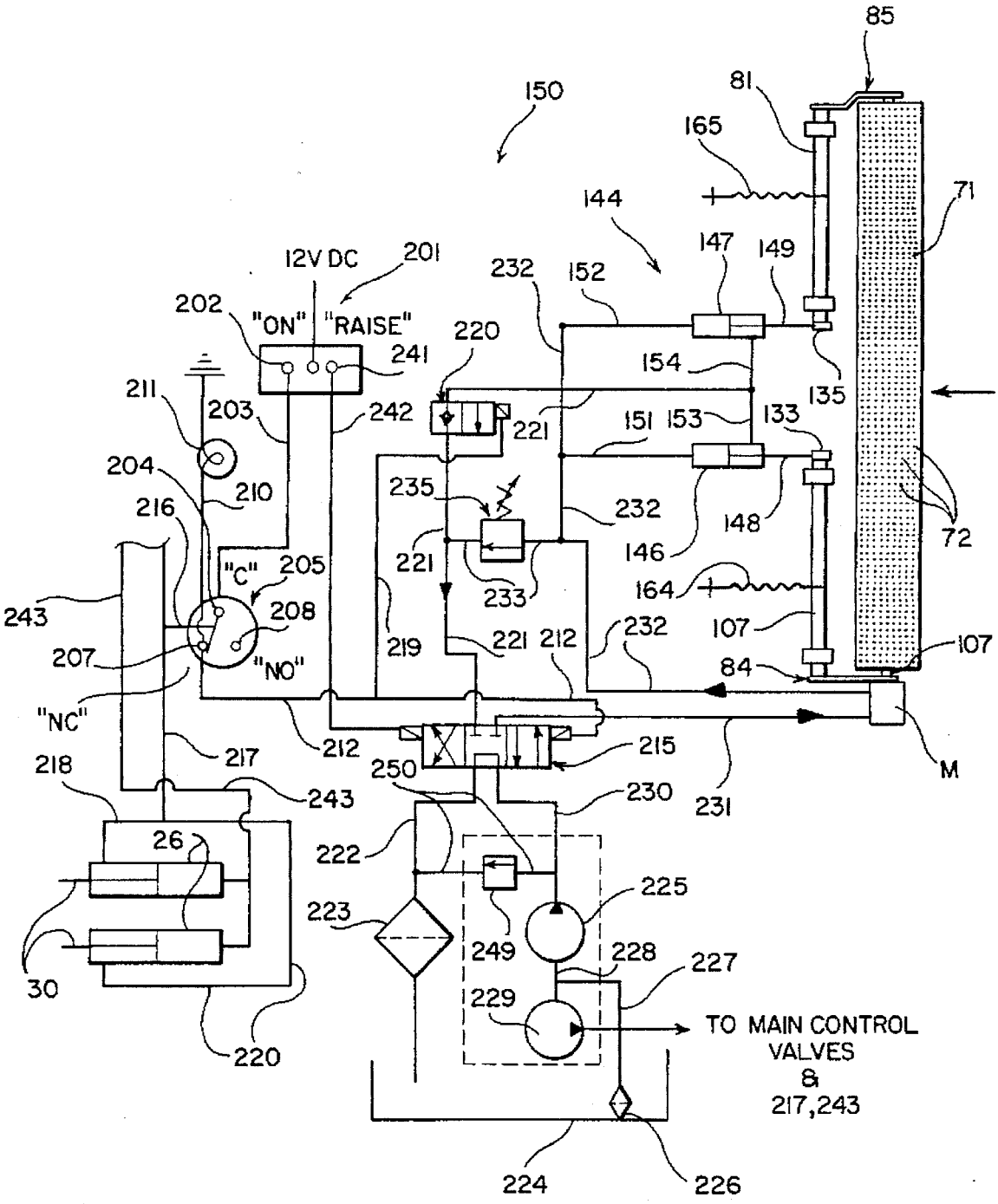
FIG. 12 is a schematic hydraulic circuit and illustrates a fluidic control system for operating a motor and fluid piston/cylinder mechanisms associated with the broom.

Reference is again made to the hydraulic circuit system 150 of FIG. 12 which additionally includes a switch 201 having an "ON" terminal 202 connected by a line 203 to a "C" terminal 204 of a pressure switch 205 having a switch arm 206 movable between an "NC" terminal 207 and a "NO" terminal 208. The terminal 207 is connected by a line 210 to an indicator light or lamp 211 to ground and by another line 212 to a solenoid (unnumbered) of a valve 215. The switch arm 206 of the pressure switch 205 is connected by a fluid line 216 to a line 217 divided into branch lines 218, 220 connected to the rod ends (unnumbered) of the cylinders 26 (FIGS. 1 and 12) of the pick-up head 10.

When the switch 201 is moved to the "ON" position, terminal 202 delivers voltage over the line 203 to the terminal 204. If the pick-up head 10 is in its raised position with the rods 30 retracted and the rod ends pressurized, the switch arm 206 of the pressure switch 205 is switched by the high pressure in the rod end of the cylinders 26 over the lines 217, 218 and 220 to the "NO" terminal 208 and power will not flow over the lines 210 or 212 which will neither light the indicator lamp 211 or energize the solenoid valve 215. However, if the pick-up head is in its lower position with the piston rods 30 extended and the rod ends depressurized, the switch arm 206 of the pressure switch 205 remains in contact with the "NC" terminal 207 allowing current flow over the lines 210, 212 to light the indicator lamp 211 and energize the solenoid of the valve 215 and over a conductor or line 219 also energizes a solenoid (unnumbered) of an electrical lock valve 220 which shifts the same from the position shown in FIG. 12 to allow hydraulic fluid (oil) to flow from the rod ends of the cylinders 146, 147 over the respective lines 154, 153, another line 221, the valve 220 in the line 221, through the shifted solenoid valve 215 which directs the fluid over a line 222 through a filter 223 into a reservoir 224. The same shifting of the valve 215 allows a pump 225 to deliver oil from the reservoir 224 through a filter 226 and lines 227, 228 and 230 through the solenoid valve 215 and over a flexible conduit or line 231 to the fluid motor M. The motor M rotates the shaft 107 (FIG. 10), the shaft 73 and, of course, the broom 71.

Oil leaves the motor M through a flexible conduit or line 232 which is in turn connected to the lines 151, 152 which direct the pressurized fluid/oil into the respective cylinders 146, 147 causing the extension of the respective rods 148, 149, the pivoting of the arms 84, 85 and, of course, the contact of the broom 71 with the surface S in the manner heretofore described. The line 232 is also connected through a T-fitting to a line 233 which includes therein a relief valve 235 which is set at 160–180 psi. The latter pressure allows the fluid to not only flow into the line 232 but also through the line 233 and the valve 235 and join the fluid exiting the rod ends of the cylinders 146, 147 over the line 221 through the valve 220 returning through the valve 215 over the line 222 and the filter 223 to the reservoir 224.

The pressure builds-up in the cylinders 146, 147 as the broom 71 is progressively forced against the surface S, and the pressure build-up is determined by the setting of the relief valve 235 (160–180 psi). When the head pressure reaches 160–180 psi, the relief valve 235 opens allowing flow through the line 233 while maintaining the set pressure in the line 232 and in the broom cylinders 146, 147 over the lines 151, 152 and exhausting the cylinders 146, 147 over the line 221.

The downward pivoting movement of the broom 71 is, of course, resisted by the tension of the springs 164, 165 and the amount of tension applied to the springs 164, 165, as described heretofore by appropriately adjusting the nuts 168, determines the down pressure of the broom 71 against the surface S being swept to establish the desired "burn pattern" heretofore described which essentially is the desired and effective width of broom-to-surface contact. The pressure of the relief valve 235 can be manually set, and the setting of the pressure of the relief valve 235 determines the "rigidity" or "stiffness" of the overall hydraulic system, namely, the fluid resistance offered by the pressure in the cylinders 146, 147 against upward pivotal movement of the broom 71 away from the surface S as a result of debris or objects in the broom path. This same pressure established by the relief valve 235 sets the "digging" ability of the broom 71, namely, the extent to which the bristles 72 thereof will dig into the surface S or deform before the arms 84, 85 will begin to pivot away from the surface S. Thus, increased resistance to this rotation of the broom 71 away from the surface S which increases pressure on the motor M does not increase the down pressure within the cylinders 146, 147 because the cylinders 146, 147 are in the circuit system 150 after or downstream stream of the motor M and, therefore, do not "see" the increased pressure generated at that point.

In order to turn the system "OFF," the switch 201 is switched from its "ON" position to break the circuit earlier described relative to and beginning with the terminal 202. The system basically stops operating, including the rotation of the broom 71, but the broom 71 is still in contact with the surface S. In order to raise the broom, the switch 201 is switched to its "RAISE" terminal 241 which energizes a solenoid (unnumbered) of the valve 215 over a line 242 and shifts the valve 215 opposite to that heretofore described which allows the pump 225 to pump oil through the line 230, the valve 215, the line 221 and the unshifted valve 220 thereof into the rod end of the cylinders 146, 147 through the lines 153, 154 causing retraction and upward pivoting of the broom 71 away from the surface S in the manner heretofore described. Fluid/oil exhausts the cylinders 146, 147 over the lines 151, 152, respectively, the line 232 and through the motor M, the line 231, the solenoid valve 215, the line 222 and the filter 223 back to the reservoir 224. The entire system is now stopped with the broom 71 in its raised position so that the switch 201 can be released and returned to its "OFF" (detented) position.

The pick-up head 10 can also be raised while the broom 71 is rotating in the manner heretofore described. Assuming that the broom 71 is rotating and is in contact with the ground, as earlier described, the pick-up head 10 is raised by pressurizing the line 217 which causes the rods 30 (FIGS. 1 and 2) to retract into the cylinders 26 with the oil being discharged over line 243. The lines 217, 243 are connected through an appropriate solenoid valve (not shown) to a pump 229. This increased pressure is sensed by the pressure sensing valve 205 over the line 216 which switches the contact switch arm 206 from the "NC" terminal 207 to the "NO" terminal 208 which simply opens the circuit over the lines 210, 212. Since there is no current flow in the line 212, the solenoid valve 215 shifts back to its neutral position and the flow of oil returns to the reservoir 224 over the line 222 and filter 223. When the pick-up head 10 is, however, lowered, which relieves the pressure on the rod end of the pick-up head cylinders 26, the switch arm 206 returns from the "NO" terminal 208 position to the "NC" terminal 207 position to resume normal operations.

A pressure relief valve 249, set at 2500 psi, is in a line 250 bridging the lines 222, 230 to by-pass excessively high pressure fluid from the line 230 through the valve 249 and the line 222 directly back to the reservoir 224 through the filter 223 to prevent damaging the pumps 225, 229, the valves and fittings, etc.

Although a preferred embodiment of the invention has been specifically illustrated and described herein, it is to be understood that minor variations may be made in the apparatus without departing from the spirit and scope of the invention, as defined the appended claims. For example, the separately formed bearings 102, 103 can be formed as a single bearing. Moreover, instead of the bearings 102, 103 being manufactured separately from the hub 104, these can be made as a single integral structure. In other words, the hub 104 can have an internal machined cylindrical bearing surface (need not be Teflon-coated).

What is claimed is:

1. A pick-up head adapted for movement along a predetermined path of travel for removing debris therealong comprising housing means for defining an air chamber defined generally between opposite side walls along which air is adapted to flow, means for defining an elongated orifice extending generally between said side walls through which pressurized air is introduced into said air chamber, said elongated orifice being defined in part by an elongated wall extending generally between said opposite side walls, said elongated wall having a generally neutral longitudinal axis, and means for deflecting said elongated wall generally about its neutral longitudinal axis to vary the size of said elongated orifice.

2. The pick-up head as defined in claim 1 including means for yieldably supporting said elongated wall generally along its neutral longitudinal axis whereby said elongated wall will additionally pivot at said yieldable supporting means in response to the operation of said deflecting means.

3. The pick-up head as defined in claim 1 wherein said deflecting means is effective for varying the shape of said elongated orifice between a first shape having generally opposite parallel first and second spaced edge portions and a second shape in which said first and second spaced edge portions are in converging/diverging relationship to each other.

4. The pick-up head as defined in claim 3 wherein said deflecting means includes a portion exposed exteriorly of said housing means.

5. The pick-up head as defined in claim 4 wherein said deflecting means includes a plurality of adjusting bolts positioned in spaced relationship along said elongated wall.

6. A pick-up head adapted for movement along a predetermined path of travel for removing debris therealong comprising housing means for defining an air chamber defined generally between opposite side walls along which air is adapted to flow, means for defining an elongated orifice extending generally between said side walls through which pressurized air is introduced into said air chamber, said elongated orifice being defined in part by an elongated wall extending generally between said opposite side walls, and means mounting said elongated wall for yieldable pivoting movement about an axis generally normal to said side walls to thereby vary the size of said elongated orifice.

7. The pick-up head as defined in claim 6 wherein said mounting means further mounts said elongated wall for yieldable pivoting movement generally normal to said axis.

8. The pick-up head as defined in claim 6 wherein said yieldable mounting means includes an opening in said elongated wall, and a rigid support member coupled through a yieldable member to said elongated wall through said elongated wall opening.

9. The pick-up head as defined in claim 6 wherein said yieldable mounting means are located along the length of said elongated wall between upper and lower edge portions thereof, and means for applying forces to said elongated wall upper edge to effect yieldable pivoting movement thereof whereby said elongated wall lower edge varies the size of said elongated orifice.

10. The pick-up head as defined in claim 9 wherein said force applying means are a plurality of adjusting bolts positioned in spaced relationship along said elongated wall.

11. A pick-up head adapted for movement along a predetermined path of travel for removing debris therealong comprising means for defining an air chamber, means for defining a broom chamber, a broom in said broom chamber, means for rotating said broom about an axis thereof to direct debris in a direction toward said air chamber, means for conducting air through said air chamber in a direction generally corresponding to said broom axis whereby debris directed by said broom toward said air chamber is entrained with and carried along by the air being conducted through said air chamber, said broom having generally axially opposite first and second end portions, first and second means for articulate mounting said respective broom first and second end portions for articulated movement in first and second directions, respectively, toward and away from an associated surface along which the pick-up head is adapted to travel, first means for urging said broom in said first direction to move said broom in said first direction whereby said broom is brought into forceful brushing contact with the surface along which the pick-up head is adapted to travel and for urging said broom in said second direction to move said broom in said second direction whereby said broom is brought out of forceful brushing contact with the surface along which the pick-up head is adapted to travel, second means for urging said broom in said second direction during the operation of said first urging means when moving said broom in said first and second directions, and means for adjusting the operation of said second urging means to compensate for broom wear.

12. The pick-up head as defined in claim 11 wherein said second urging means is a spring and said adjusting means includes a threaded member.

13. The pick-up head as defined in claim 11 wherein said first urging means include first and second fluid cylinder means for independently urging said respective first and second articulate mounting means in said first and second directions.

14. The pick-up head as defined in claim 13 wherein said second urging means include first and second spring means for independently urging said respective first and second articulate mounting means in said second direction.

15. The pick-up head as defined in claim 11 wherein said second urging means include first and second spring means for independently urging said respective first and second articulate mounting means in said second direction.

* * * * *